US007531481B2

(12) United States Patent
Kolbo

(10) Patent No.: US 7,531,481 B2
(45) Date of Patent: May 12, 2009

(54) METHOD FOR TRANSFERRING A DYE SUBLIMATION INK IMAGE ONTO AN ELASTOMERIC SUBSTRATE

(76) Inventor: Philip A. Kolbo, 567 Camino Mercado, Suite A, Arroyo Grande, CA (US) 93420

( * ) Notice: Subject to any disclaimer, the term of this patent is extended or adjusted under 35 U.S.C. 154(b) by 359 days.

(21) Appl. No.: 11/277,061

(22) Filed: Mar. 21, 2006

(65) Prior Publication Data

US 2007/0225165 A1 Sep. 27, 2007

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS 4,059,471 A * 11/1977 Haigh ..... 156/244.27
4,063,878 A 12/1977 Weeks
4,292,103 A 9/1981 Namura et al.
4,760,049 A 7/1988 Etzbach et al.
4,837,199 A 6/1989 Morishita et al.
4,880,324 A 11/1989 Sato et al.
5,242,781 A * 9/1993 Ohbayashi et al. ..... 430/203
5,411,783 A * 5/1995 Mahn, Jr. ..... 428/79
5,453,494 A 9/1995 Kirlin et al.
5,698,363 A 12/1997 Katsuda et al.
5,718,792 A 2/1998 Goode
5,718,793 A * 2/1998 Inamoto et al. ..... 156/235
5,736,233 A 4/1998 Fye
5,858,160 A 1/1999 Piacente et al.
6,025,023 A 2/2000 Valente et al.
6,030,661 A 2/2000 Kordina et al.
6,126,699 A 10/2000 McCurley
6,246,428 B1 * 6/2001 Look et al. ..... 347/212
6,450,633 B1 9/2002 Kronzer
6,557,898 B2 * 5/2003 Kissinger et al. ..... 283/70
6,572,921 B1 6/2003 Rousselet
6,689,717 B2 * 2/2004 Fujimori ..... 503/227
6,723,383 B2 4/2004 Nigam
6,746,986 B1 6/2004 Sato
6,759,096 B2 7/2004 MacQueen et al.
6,937,153 B2 8/2005 Redlin
7,220,705 B2 * 5/2007 Hare ..... 503/227
2001/0003603 A1 6/2001 Eguchi et al.
2002/0182392 A1 12/2002 Welch, Jr. et al.
2004/0003295 A1 1/2004 Elderfield et al.
2004/0014838 A1 1/2004 Tollhupp
2004/0069172 A1 4/2004 Horne et al.
2004/0151899 A1 8/2004 Sato et al.
2004/0191524 A1 9/2004 Lodge
2004/0219296 A1 11/2004 Wagner et al.
2005/0089633 A1 4/2005 Fenzi
2005/0089711 A1 4/2005 Hossick-Schott

* cited by examiner

*Primary Examiner*—Bruce H Hess
(74) *Attorney, Agent, or Firm*—Philip A. Steiner

(57) ABSTRACT

A method for transferring a dye sublimation ink image onto an elastomeric substrate which includes preheating the elastomeric substrate in which the dye sublimation ink image is to be transferred until the elastomeric substrate has thermally expanded, while the elastomeric substrate is still thermally expanded, disposing the dye sublimation ink image on top of the portion and applying at least a sufficient amount of heat onto the elastomeric substrate to effectively transfer the dye sublimation ink image onto the elastomeric substrate. Preheating of the elastomeric substrate is accomplished at temperature ranging from approximately 360 to 410 degrees Fahrenheit for at least 20 seconds.

18 Claims, 1 Drawing Sheet

METHOD FOR TRANSFERRING A DYE SUBLIMATION INK IMAGE ONTO AN ELASTOMERIC SUBSTRATE

CROSS-REFERENCE TO RELATED APPLICATIONS

Not Applicable

FEDERALLY SPONSORED RESEARCH AND DEVELOPMENT

Not Applicable

REFERENCE TO A MICROFICHE APPENDIX

Not Applicable

FIELD OF INVENTION

The present invention relates generally to a printing method and more specifically to a printing method for transferring dye sublimation dye images onto an elastomeric substrate such as neoprene.

BACKGROUND

Dye sublimation printing has certain advantages over standard ink jet and electrostatic transfer printing mechanisms in that the image quality of the printed output is significantly greater. This is particularly true when multicolor high resolution graphics are involved. Dye sublimation printing has also been used to produce multiple color graphics in certain products. In this technique, specially formulated inks disposed on a carrier, for example, a transfer paper, are brought into contact with an area of a substrate that is to be colored. Through the application of heat and pressure, the dye or colorant in the ink is driven into the substrate.

Under proper process conditions, the dyes change state from a solid to a gas (i.e., sublime), thereby facilitating penetration into the substrate. The dye gases typically penetrate the surface of the substrate about 0.001 inches to about 0.005. The sublimation process has been used to put dark graphics on opaque, light-colored computer keyboard key caps. Sublimation printing has also been used to place colored designs on white or light-colored plastics and synthetic fabrics having minimal deformable characteristics.

Sublimation dyes are available from a variety of suppliers as either screen printing inks or as inks pre-printed on a carrier in custom designs. Sublimation processes are discussed in detail in U.S. Pat. Nos. 5,270,507; 5,736,233; 5,071,824 and 5,980,221, which are hereby incorporated by reference as if fully set forth herein.

However, a problem exists when attempting to utilize dye sublimation printing of deformable elastomeric substrates such as neoprene. The heat and pressure used in dye sublimation printing causes the substrates to expand at the same time in which the sublimation ink is applied to the elastomeric substrate. This causes the resultant image to be appear distorted, smeared and/or doubled; thus defeating one of the many advantages of dye sublimation printing.

SUMMARY

Various exemplary embodiments as described herein address the substrate expansion problem in the current relevant art. In various methodic embodiments, processes are provided which solves the image distortion problem when using dye sublimation printing on elastomeric substrates. As used herein, the term "image" includes both graphics and text. In a first embodiment, a method for transferring a dye sublimation ink image onto an elastomeric substrate is provided.

The first methodic embodiment comprises: preheating a portion of the elastomeric substrate in which the dye sublimation ink image is to be transferred until the portion of the elastomeric substrate has thermally expanded; while the portion of the elastomeric substrate is still thermally expanded, disposing the dye sublimation ink image on top of the heated portion; and applying a sufficient amount of heat onto at least this portion to effectively transfer the dye sublimation ink image onto the elastomeric substrate.

In a related embodiment, the dye sublimation ink image used is initially disposed onto at least one sheet of thermal transfer paper. In other related embodiments, the preheating is accomplished for at least 20 seconds at a temperature range of approximately 360 to 410 degrees Fahrenheit; the sufficient amount of heat is provided in a temperature range of approximately 360 to 410 degrees Fahrenheit for a sufficient amount of time, where the sufficient amount of time is in a range of approximately 45 to 90 seconds.

In other related embodiments, the elastomeric substrate is arranged in a sheet form having a thickness in a range of approximately 1.5 millimeters to 6.0 millimeters; the elastomeric substrate is a synthetic rubber, for example neoprene.

The second methodic embodiment for transferring a dye sublimation ink image onto an elastomeric substrate comprises: preheating an area of the elastomeric substrate for at least 20 seconds; immediately thereafter, placing the dye sublimation ink image on top of the heated area in a desired arrangement; and applying an effective amount of heat and pressure for about 45-90 seconds onto the area to transfer the dye sublimation ink image onto the elastomeric substrate.

In related embodiments, the sufficient amount of heat is approximately 370-410 degrees Fahrenheit; the sufficient amount of pressure is in a range of approximately 0.5-5.0 pounds per square inch; the sufficient amount of pressure is in a range of light to medium.

In other related embodiments, the elastomeric substrate consists essentially of a synthetic rubber having a fabric covering selected from the group of; polyisoprene, polybutadiene, polychloroprene, ethylene propylene and chlorosulfonated polyethylene; and the elastomeric substrate is polychloroprene (neoprene.)

The third methodic embodiment for transferring a dye sublimation ink image onto an elastomeric substrate comprises: preheating an area of the elastomeric substrate in a thermal transfer press for at least 20 seconds; immediately thereafter, placing the dye sublimation ink image on top of the heated area in a desired arrangement; and heating at least the area to a temperature in a range of approximately 360-410 degrees Fahrenheit at a pressure in a range of approximately 0.5-5.0 psig for about 45-90 seconds to transfer the dye sublimation ink image onto the elastomeric substrate.

In related embodiments, the elastomeric substrate is arranged in a sheet form having a thickness in a range of approximately 1.5 millimeters to 6.0 millimeters; the elastomeric substrate is a synthetic rubber for example neoprene; and the preheating is conducted at a temperature in a range of 360-410 degrees Fahrenheit.

BRIEF DESCRIPTION OF THE DRAWINGS

The features and advantages will become apparent from the following detailed description when considered in conjunction with the accompanying drawings.

Where possible, the same reference numerals and characters are used to denote like features, elements, components or portions aspects of the various embodiments of the inventions. Optional components or feature are generally shown in dashed or dotted lines. It is intended that changes and modifications can be made to the described embodiment without departing from the true scope and spirit of the subject invention.

DETAILED DESCRIPTION

Figure 1:
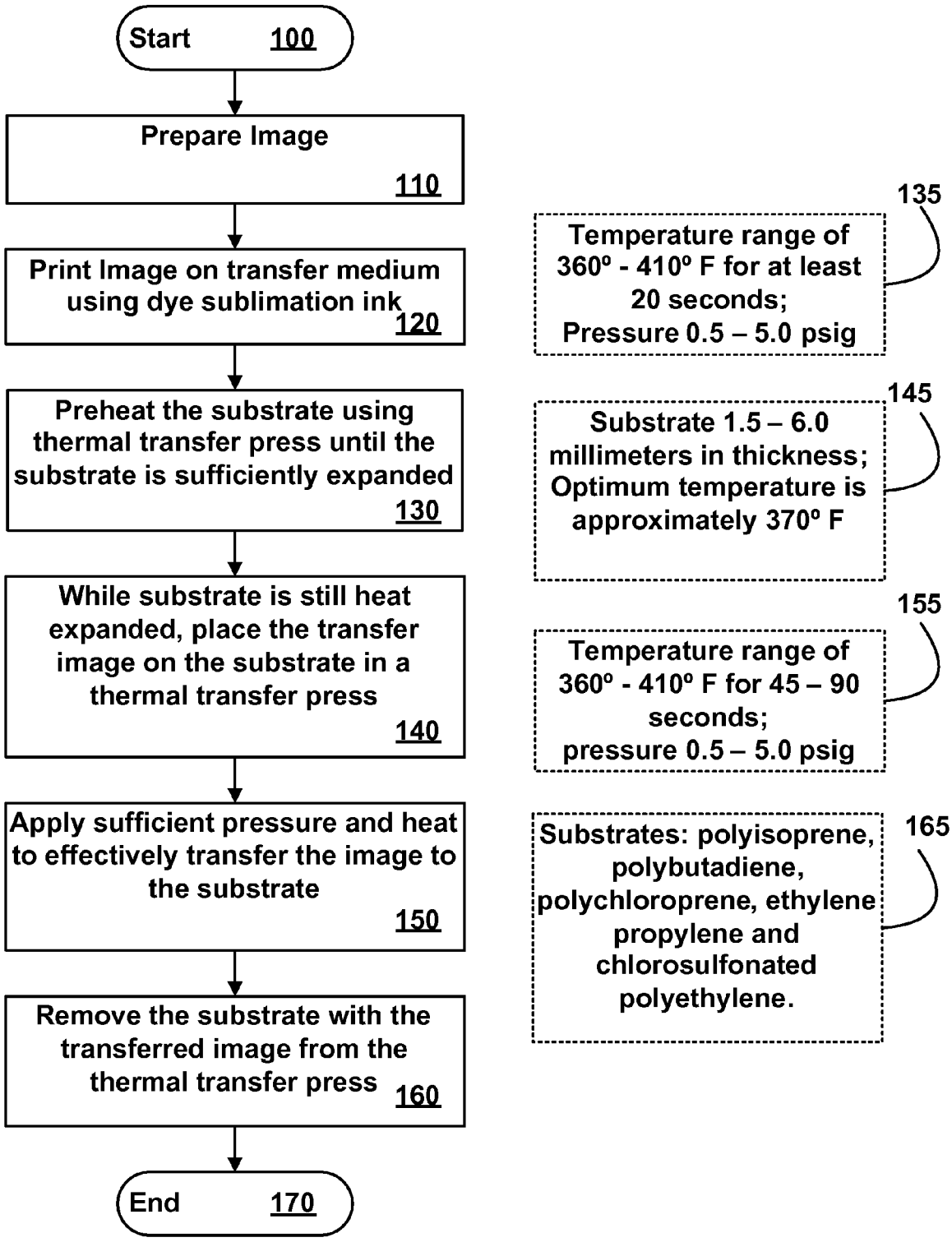
FIG. 1—depicts a generalized process flow diagram of the various embodiments.

In various embodiments, a portable media player is provided with expanded capabilities to receive contemporaneous newscasts from an external content provider which is intelligently played according to a users preestablished receiving and playback preferences.

Referring to FIG. 1, an exemplary process flow diagram is depicted. The process is initiated 100 by preparing an image using dye sublimation ink. The prepared image is then printed onto a suitable transfer medium 120, for example, a thermal transfer paper. Suitable dye sublimation printers, ink, and thermal transfer paper are available from a wide variety of printer vendors, for example, Epson America, Inc.; Hewlett Packard, Inc. and Canon, Inc.

Once the image has been transferred onto the transfer medium, the elastomeric substrate is preheated to allow for compressive and thermal expansion prior to application of the dye sublimation image 130. The preheating of the elastomeric substrate is generally accomplished using a thermal press. For example, the Insta™ 204 thermal press; available from Insta Graphic Systems™, 13925 East 166th Street, Cerritos, Calif., 90702, U.S.A. Other preheating and/or pre-stretching processes may be used as well. The preheating process is accomplished by placing the elastomeric substrate in the thermal press, closing the thermal press onto the elastomeric substrate for at least 20 seconds. The preheating time may need to be increased with large area elastomeric substrates and/or elastomeric substrates having relatively thin thicknesses. The preheating temperature should be in the same general range as that used to actually transfer the dye sublimation ink image to the elastomeric substrate. On skilled in the art will appreciate that larger surface area thermal presses may used to implement the transfer process.

A typical preheating temperature range is approximately 360-410 degrees Fahrenheit 135, with an optimum temperature being approximately 370 degrees Fahrenheit. Increasing the temperature much beyond 410 degrees Fahrenheit may risk scorching of the elastomeric substrate. The amount of pressure to be used varies with each manufacturer's thermal press design and is generally maintained at a light or light to medium setting for both the preheating and actual transfer of the dye sublimation ink image to the elastomeric substrate. The actual range of pressures suitable for the process is estimated to be 0.5-5.0 pounds per square inch for elastomeric substrate thicknesses of 1.5-6.0 millimeters 145. One skilled in the art will appreciate that some variability in image quality may be encountered due to differences in thermal press design, elastomeric substrate uniformity, and chemical formulations of the sublimation ink used in the process.

After a sufficient amount of heat has been applied to the elastomeric substrate to allow for thermal and compressive expansion, the thermal press is opened, and while the elastomeric substrate is still thermally expanded, the transfer medium having the dye sublimation ink image disposed thereon is placed onto the preheated elastomeric substrate in a desired arrangement, position or orientation 140. The thermal press is then again closed for a sufficient time, generally 45-90 seconds 150, to allow the dye sublimation ink image to sublime into the elastomeric substrate 155. Again, the time may vary somewhat due to variations in thicknesses of the elastomeric substrate and the dimensions of the dye sublimation ink image to be transferred. After sufficient amount of time has elapsed to allow the dye sublimation ink image to be transferred, the elastomeric substrate is removed from the thermal press 160, ending the process 170.

The types of elastomeric substrates to be used in this process include a wide variety of rubber products both natural and synthetic. Examples include elastomers of polyisoprene, polybutadiene, polychloroprene, ethylene propylene and chlorosulfonated polyethylene 165. Preferably, the elastomeric substrates are provide in sheet form, having thicknesses of 1.5-6.0 millimeters and a fabric covering on at least one surface of the sheet.

The fabric covering may be any common material including cotton, nylon, polypropylene, polyester and other related synthetic and natural fabrics and fabric blends. The color of the fabric is preferably white or otherwise light in color to allow the transferred image to be visible, if desired.

Alternately, if a portion of the transferred image is intended to be invisible until subjected to an ultraviolet or infrared light source, for example as a watermark or authenticity indicator, the fabric color may match a portion of the transferred image to mask the presence of the watermark or authenticity indicator.

In a preferred embodiment of the invention, the elastomeric substrate comprises neoprene having a white or off-white colored fabric covering and a thickness in the range of 1.5-6.0 millimeters. One skilled in the art will appreciate that the other compositions of elastomeric substrates and various fabrics may used in the described inventive embodiments disclosed herein without limiting of the scope of the invention.

This invention has been described in detail with reference to various embodiments. It should be appreciated that the specific embodiments described are merely illustrative of the principles underlying the inventive concept. It is therefore contemplated that various modifications of the disclosed embodiments will, without departing from the spirit and scope, be apparent to persons of ordinary skill in the art. As such, the foregoing described embodiments are provided as exemplary illustrations and descriptions. They are not intended to limit the invention to any precise form described.

In addition, no specific limitation is intended to a particular arrangement, equipment or process sequence. Other variations and embodiments are possible in light of above teachings, and it is not intended that this Detailed Description limit the scope of invention, but rather by the Claims following herein.

What is claimed:

1. A method for transferring a dye sublimation 5 ink image onto an elastomeric substrate comprising:

preheating a portion of said elastomeric substrate in which said dye sublimation ink image is to be transferred until said portion of said elastomeric substrate has thermally expanded, wherein said preheating is conducted in a temperature range of approximately 360 to 410 degrees Fahrenheit;

while said portion of said elastomeric substrate is still thermally expanded, disposing said dye sublimation ink image on top of said portion; and, applying a sufficient amount of heat onto at least said portion to effectively transfer said dye sublimation ink image to said elastomeric substrate.

2. The method according to claim 1 wherein said dye sublimation ink image is disposed on at least one sheet thermal transfer paper.

3. The method according to claim 1 wherein said preheating is accomplished for at least 20 seconds.

4. The method according to claim 1 wherein said sufficient amount of heat is conducted in a range of approximately 360 to 410 degrees Fahrenheit for a sufficient amount of time.

5. The method according to claim 4 wherein said sufficient amount of time is in a range of approximately 45 to 90 seconds.

6. The method according to claim 1 wherein said elastomeric substrate is arranged in a sheet form having a thickness in a range of approximately 1.5 millimeters to 6.0 millimeters.

7. The method according to claim 1 wherein said elastomeric substrate is a synthetic rubber having a fabric covering on at least on surface.

8. The method according to claim 1 wherein said elastomeric substrate is neoprene.

9. A method for transferring a dye sublimation ink image onto an elastomeric substrate comprising:

preheating an area of said elastomeric substrate for at least 20 seconds at a temperature range of approximately 360 to 410 degrees Fahrenheit;

immediately thereafter, placing said dye sublimation ink image on top of said area in a desired arrangement; and, applying an effective amount of heat and pressure for about 45-90 seconds onto said area to transfer said dye sublimation ink image onto said elastomeric substrate.

10. The method according claim 9 wherein said effective amount of heat is approximately 370-410 degrees Fahrenheit.

11. The method according claim 9 wherein said effective amount of pressure is in a range of approximately 0.5-5.0 pounds per square inch.

12. The method according claim 9 wherein said effective amount of pressure is in a range of light to medium.

13. The method according claim 9 wherein said elastomeric substrate consists essentially of a synthetic rubber selected from the group of; polyisoprene, polybutadiene, polychloroprene, ethylene propylene and chlorosulfonated polyethylene.

14. The method according claim 9 wherein said elastomeric substrate is polychloroprene having a fabric covering on at least one surface.

15. A method for transferring a dye sublimation ink image onto an elastomeric substrate comprising:

preheating an area of said elastomeric substrate in a thermal transfer press for at least 20 seconds, wherein said preheating is conducted in a temperature range of 360 to 410 degrees Fahrenheit;

immediately thereafter, placing said dye sublimation ink image on top of said area in a desired arrangement; and, heating at least said area to a temperature in a range of approximately 360-410 degrees Fahrenheit at a pressure in a range of approximately 0.5-5.0 psig for about 45-90 seconds to transfer said dye sublimation ink image onto said elastomeric substrate.

16. The method according to claim 15 wherein said elastomeric substrate is arranged in a sheet form having a thickness in a range of approximately 1.5 millimeters to 6.0 millimeters.

17. The method according to claim 15 wherein said elastomeric substrate is a synthetic rubber having a fabric covering on at least one surface.

18. The method according to claim 15 wherein said elastomeric substrate is neoprene.

* * * * *